US005508474A

United States Patent [19]

Tumura

[11] Patent Number: 5,508,474

[45] Date of Patent: Apr. 16, 1996

[54] ELECTROMAGNETIC PICKUP FOR AN ELECTRIC STRINGED INSTRUMENT

[75] Inventor: Kenji Tumura, Osaka, Japan

[73] Assignee: Fernandes Co., Ltd., Japan

[21] Appl. No.: 278,816

[22] Filed: Jul. 22, 1994

[30] Foreign Application Priority Data

Jul. 22, 1993 [JP] Japan ..... 5-181540

[51] Int. Cl.[6] ..... G10H 1/06; G10H 3/18

[52] U.S. Cl. ..... 84/726; 84/727; 84/735

[58] Field of Search ..... 84/726, 727, 728, 84/735, 736

[56] References Cited

U.S. PATENT DOCUMENTS 2,894,491 7/1959 Hecht ..... 121/41

3,236,930 2/1966 Fender ..... 84/1.15

4,809,578 3/1989 Lace ..... 84/1.15

*Primary Examiner*—Stanley J. Witkowski

*Attorney, Agent, or Firm*—Finnegan, Henderson, Farabow, Garrett & Dunner

[57] ABSTRACT

An electromagnetic pickup for an electric stringed instrument has, two parallel permeability plates placed perpendicular to strings; a permanent magnet provided between the two permeability plates in parallel to strings; and a coil wound around the permanent magnet. The plate permanent magnet is in contact with the permeability plates in such a manner that the portions of the permanent magnet that contact the permeability plates have oppsite polarities.

6 Claims, 3 Drawing Sheets

ELECTROMAGNETIC PICKUP FOR AN ELECTRIC STRINGED INSTRUMENT

BACKGROUND OF THE INVENTION

1. Field of the Invention

The present invention relates to an electromagnetic pickup for an electric stringed instrument, e.g., an electric guitar or an electric piano, which converts a vibration signal to an electric signal by detecting the vibration of a string, and more particularly to an electromagnetic pickup for an electric stringed instrument that enables the great reduction in undesired noise, e.g., an electromagnetic noise, an electrostatic noise, an induced noise, etc.

2. Description of the Related Art

Generally, an electric stringed instrument, e.g., an electric guitar or an electric piano, has plural strings and a pickup for converting the vibration of a string to an electrical signal. There are two well-known types of pickups. One is an electromagnetic type of pickup and the other is a piezoelectric type of pickup. Particularly, in the case of an electric guitar, the electromagnetic type of pickup has been used since the introduction of the electric guitar, because by using the electromagnetic type of pickup it is easy to mount the pickup on the body of an electric guitar, to obtain a sound characteristic that emphasizes a medium sound region, and to process the resultant electrical signal.

The conventional configuration of a so-called "single coil type pickup" consists of a plurality of pole pieces each made of a cylindrical magnetic body, i.e., a permanent magnet, and respectively disposed corresponding to each string; a coil wound around the plurality of pole pieces; a bobbin on which the coil is wound; and a cover. The operation principle of a single coil type pickup is as follows. The pole pieces always emit magnetic flux from their top sections into a space above the pickup. When the strings vibrate in the space, the amount of the magnetic flux is changed, thereby inducing an electromotive force in response to the vibration of the strings, according to Fleming's right hand rule.

Arranging an electromagnetic pickup as described above, sharp and clear sound characteristics can be realized. Thus, a single coil type pickup is currently used. However, the configuration of a single coil type pickup is nearly the same as that of an antenna. Therefore, there is a problem in that such a single coil type pickup easily detects induced extraneous noise in addition to a normal vibration signal of strings, and thereby undesired noise is caused. Such induced noise that is roughly grouped into electromagnetic noise and electrostatic noise caused by an induced electromagnetic waves emitted from, e.g., an illumination device, a transformer, a vacuum tube, a radio receiver, etc. In particular, if a noise source exists in the direction of the axis of the pole pieces of the pickup, the induced noise has a significantly effect on an electromagnetic pickup.

To solve the problem described above, a humbucking type electromagnetic pickup disclosed in U.S. Pat. No. 2,894,491, was proposed by Seth E. Lover. This type of electromagnetic pickup is a so-called "double coil type pickup" or "humbucking pickup" that is basically formed as a parallel arrangement of two single coil type pickups. As described above, the two single coil type pickups respectively detect a vibration signal of a string and induced extraneous noise. However, since the pair of coils in this type of pickup are connected in reverse phase, induced noise is essentially cancelled out. Further, since the two rows of pole pieces in pickup have reverse magnetic poles from each other, electromotive force produced by the string vibration is added to and thereby increases.

In a humbucking pickup, induced noise is reduced as described above, and further, a powerful and sustained sound is obtained in comparison with a single coil type pickup. However, a humbucking pickup uses two single coil type pickups and detects the vibration of a string at two locations corresponding to the two single coil type pickups. Thereby, the two electromotive forces produced in coils of the pickups differ subtly from each other. Consequently, the waveform and phase of the overall output signal is distorted by the summing of the two electromotive forces and, in particular, the string vibration components consisting of harmonic overtones are decreased. Therefore, there is a problem in that a humbucking pickup outputs less clear and lower frequency sounds than a single coil type pickup. Further, there is a problem in that induced noises caused in the two single coil type pickups cannot completely cancel each other, because the pickups independently detect the vibration of a string at different points. Furthermore, there is a problem in that a humbucking pickup requires many components and thus is larger and more expensive. Therefore, the number of humbucking pickups that can be mounted on the body of a guitar is limited.

On the other hand, another type of single coil type electromagnetic pickup was disclosed in U.S. Pat. No. 3,236,930 by Clarence L. Fender. This electromagnetic pickup was developed for the purpose of reduction of induced noise. In this electromagnetic pickup, the bottom and side sections of the pickup, excluding the top section closest to the strings, are covered with permeability plates in order to reduce induced noise entering from the bottom and side directions, and further, to form a closed loop path conducting magnetic flux emitted from a pole piece and thereby reduce the effect of induced noise entering from the top direction.

However, it is not enough to reduce the effect of induced noise entering obliquely from the top direction, but it is also necessary to reduce the effect of induced noise entering from the axis direction of a pole piece.

SUMMARY OF THE INVENTION

The purpose of the present invention is to provide an electromagnetic pickup for an electric stringed instrument that solves the problems described above and enables a remarkable reduction in undesired induced noise, by changing the arrangement of usual pickup components.

According to the present invention, there is provided an electromagnetic pickup that has: two parallel permeability plates placed perpendicular to the string; a plate shaped permanent magnet provided between the two permeability plates in parallel to the string; and a coil wound around the permanent magnet. The permanent magnet is in contact with the permeability plates in such a manner that the positions of the permanent magnet that contact the permeability plates have opposite magnetic polarities.

Further, according to the present invention, there is provided an electromagnetic pickup, in which at least one of the parallel permeability plates is electrically connected to the ground side of the coil.

The two permeability plates effectively emit magnetic flux provided by the permanent magnet by forming a magnetically closed loop in a small area. Further, each permeability plate operates as a shunt plate for extraneous noise and prevents the generation of noise inside the coil. Furthermore, even if noise is induced in the coil, it enters perpendicular to the axis of the coil and thus electromotive force cannot be induced.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
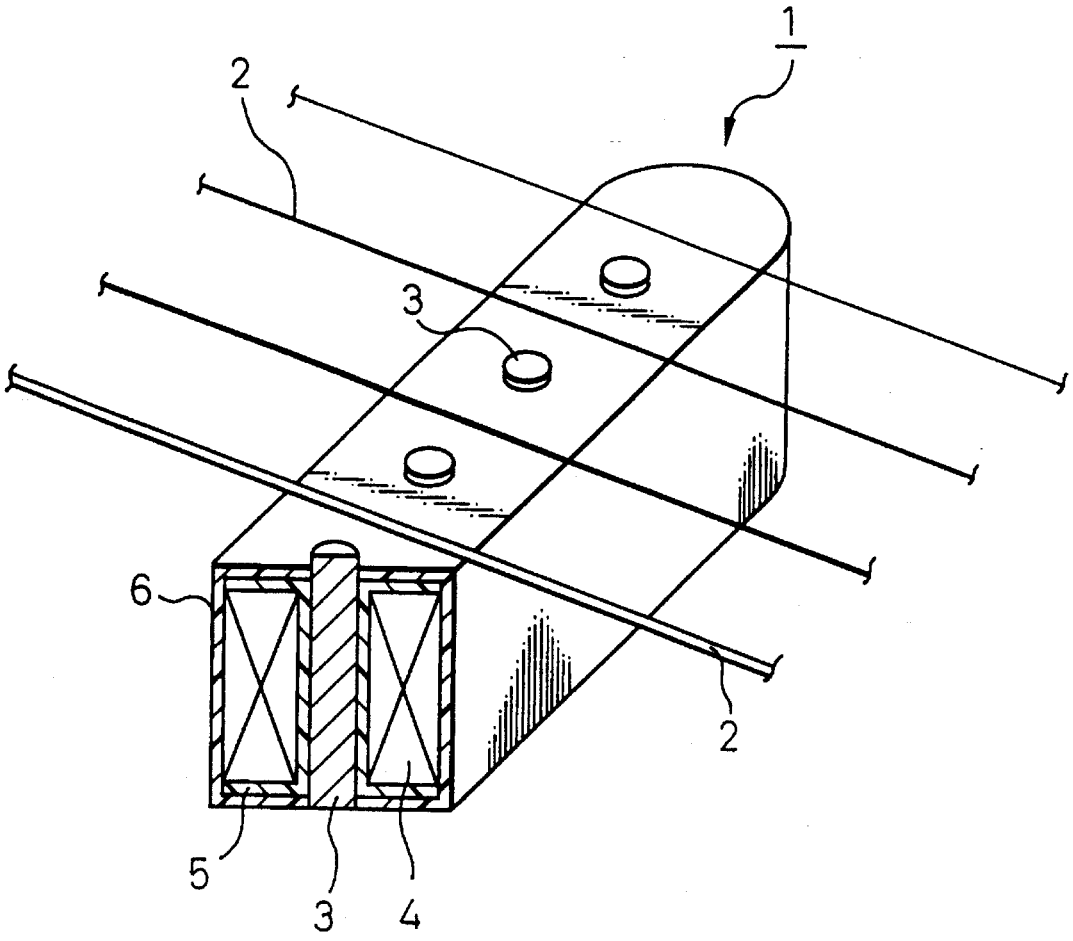
Fig.1 PRIOR ART
FIG. 1 is a cross-sectional perspective view of a prior art single coil type pickup.

Before describing the preferred embodiments according to the present invention, examples of the related art are provided with reference to FIG. 1.

FIG. 1 shows the configuration of a so-called single coil type pickup. In FIG. 1, the single coil type pickup 1 consists of a plurality of pole pieces 3 each made of a cylindrical magnetic body, i.e., a permanent magnet, respectively disposed so as to correspond to each of strings 2; a coil 4 wound around the plurality of pole pieces 3, a bobbin 5 around which the coil 4 is wound; and a cover 6. This type of electromagnetic pickup is called "a single coil type pickup" because it uses only one coil 4. The operation principle of a single coil type pickup is as follows. The pole pieces 3 always emit magnetic flux from their top sections into a space above the pickup. When the strings 2 vibrate in that space, the amount of the magnetic flux is changed, thereby inducing an electromotive force in response to the vibration of the strings 2, according to Fleming's right hand rule.

Arranging an electromagnetic pickup as described above, sharp and clear sound characteristics can be realized. Thus, a single coil type pickup is currently used. However, the configuration of a single coil type pickup is nearly the same as that of an antenna. Therefore, there is a problem in that such a single coil type pickup 1 easily detects induced extraneous noise in addition to a normal vibration signal of the strings 2, and thereby undesired noise is caused. Such induced noise that is roughly grouped into electromagnetic noise and electrostatic noise, caused by an induced electromagnetic waves emitted from, e.g., an illumination device, a transformer, a vacuum tube, a radio receiver, etc. In particular, if a noise source exists in the direction of the axis of the pole pieces 3 of the pickup, the induced noise has a significant effect on an electromagnetic pickup.

To solve the problem described above, a so-called "double coil type pickup" or "humbucking pickup" is proposed. The humbucking pickup is basically formed as a parallel arrangement of the two single coil type pickups 1 as shown in FIG. 1. As described above, two single coil type pickups respectively detect a normal vibration signal of a string and induced extraneous noise. However, since the pair of coils in this type of pickup are connected in reverse phase, induced noise is essentially cancelled out. Further, since the two rows of pole pieces in pickup have reverse magnetic poles from each other, electromotive force produced by the string vibration is added to and thereby increases.

In a humbucking pickup, induced noise is reduced as described above, and further, a powerful and sustained sound is obtained in comparison with a single coil type pickup. However, a humbucking pickup uses two single coil type pickups and detects the vibration of a string at two locations corresponding to the two single coil type pickups. Thereby, the two electromotive forces produced in the coils of the pickups differ subtly from each other. Consequently, the waveform and phase of the overall output signal is distorted by the summing of the two electromotive forces and, in particular, the string vibration components consisting of harmonic overtones are decreased. Therefore, there is a problem in that a humbucking pickup outputs less clear and lower frequency sounds than a single coil type pickup. Further, there is a problem in that induced noises caused in the two single coil type pickups cannot completely cancel each other, because the pickups independently detect the vibration of a string at different points. Furthermore, there is a problem in that a humbucking pickup required many components and thus is larger and more expensive. Therefore, the number of humbucking pickups that can be mounted on the body of a guitar is limited.

On the other hand, another type of single coil type electromagnetic pickup was proposed. This electromagnetic pickup was developed for the purpose of reduction of induced noise. In the electromagnetic pickup, the bottom and side sections of the pickup, excluding the top section closest to the strings, are covered with permeability plates in order to reduce induced noise entering from the bottom and side directions, and further, to form a closed loop path conducting magnetic flux emitted from a pole piece and thereby reduce the effect of induced noise entering from the top direction.

However, it is not enough to reduce the effect of induced noise entering from the top direction, but it is also necessary to reduce the effect of induced noise entering from the axis direction of a pole piece.

In the following, preferred embodiments of an electromagnetic pickup for an electric stringed instrument according to the present invention are explained with reference to FIGS. 2 to 4.

Figure 2:
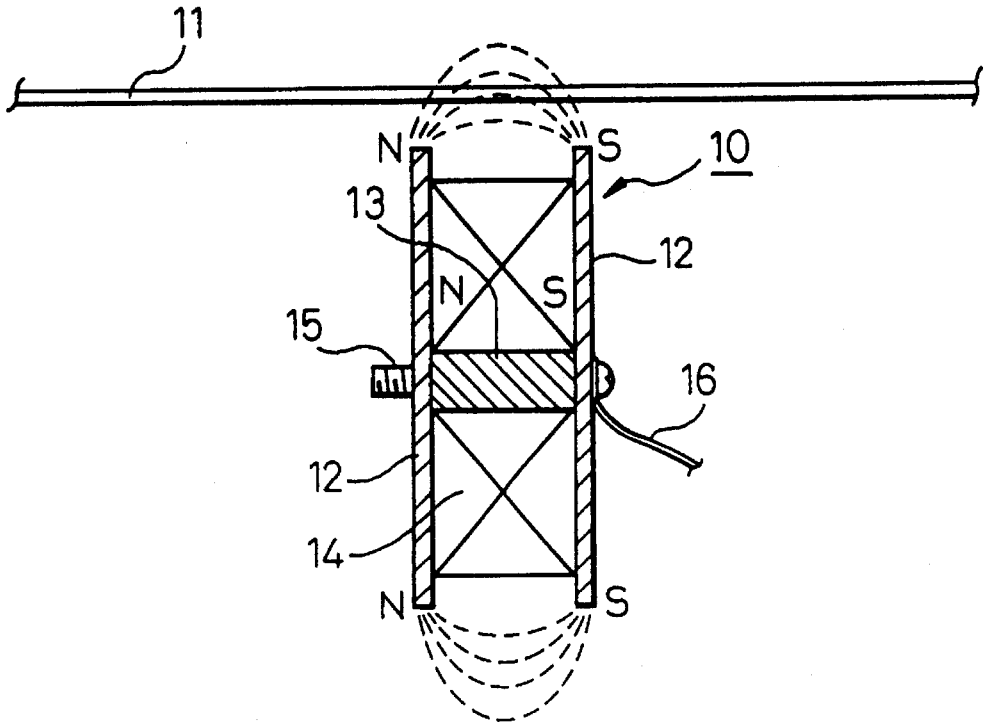
FIG. 2 is a cross-sectional view of an electromagnetic pickup for an electric stringed instrument according to the present invention.

FIG. 2 is a cross-sectional view of an electromagnetic pickup for an electric stringed instrument according to the present invention.

Figure 3:
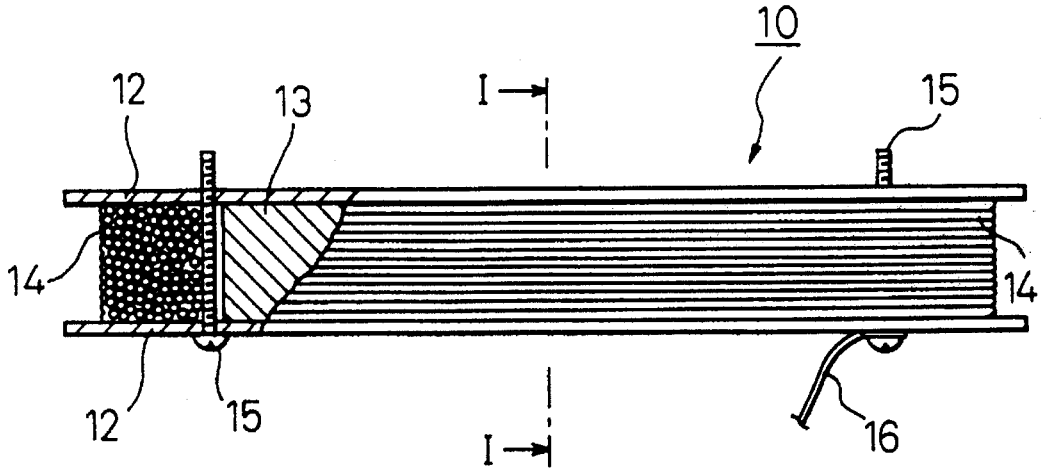
FIG. 3 is a partially cross-sectional top view of an electromagnetic pickup for an electric stringed instrument according to the present invention.

FIG. 3 is a partially cross-sectional top view of an electromagnetic pickup for an electric stringed instrument according to the present invention.

Figure 4:
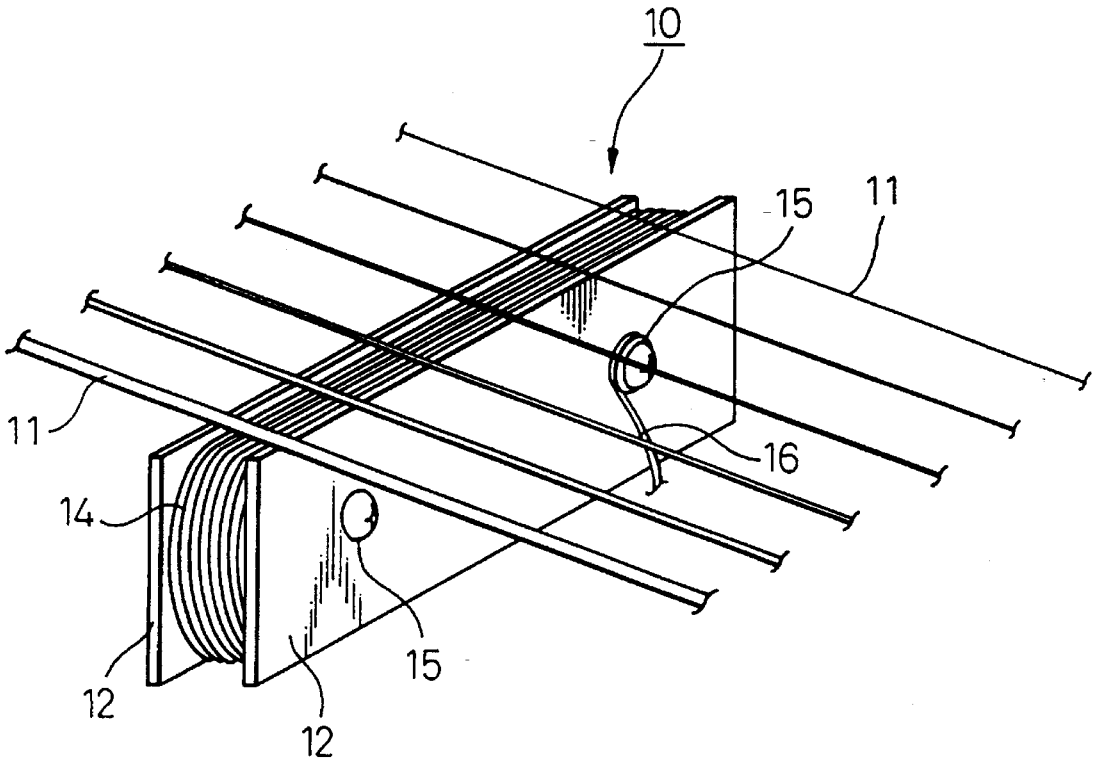
FIG. 4 is a perspective view of an electromagnetic pickup for an electric stringed instrument according to the present invention.

FIG. 4 is a perspective view of an electromagnetic pickup for an electric stringed instrument according to the present invention.

In FIGS. 2 to 4, reference numeral 10 is an electromagnetic pickup, and reference numeral 11 is a string. The electromagnetic pickup 10 is mounted on, e.g., the body of an electric guitar (not shown in the figures), and both ends of the string 11 are fixed at, e.g., a tailpiece and a tuning peg of an electric guitar (not shown in the figures).

The electromagnetic pickup 10 has two parallel permeability plates 12 placed perpendicular to the string 11, a plate shaped permanent magnet 13 provided between the two permeability plates 12 in parallel to the string 11, and a coil 14, wound around the permanent magnet 13. The permanent magnet 13 is in contact with the permeability plates 12 in such a manner that the positions of the permanent magnet 13 that contact the permeability plates have opposite magnetic polarities. The permanent magnet 13 is fixed between the permeability plates 12 by two screws 15.

The permeability plates 12 are made of permeable materials, e.g., iron with a thickness of about 1 mm, silicon steel plate, etc. The permeability plates 12 are combined with the permanent magnet 13, so as to emit magnetic flux from the permanent magnet 13 to the space above the pickup. The coil 14 is wound with approximately 7,000 turns using copper wire with, e.g., a diameter of 0.05 mm. The gap width between the permeability plates 12 is approximately 5 mm. Reference numeral 16 is a ground wire. One end of the ground wire 16 is electrically connected to the permeability plate 12 by one of the screws 15, and the other end is electrically connected to the ground of an electric guitar which is in turn electrically connected to the ground side of the coil 14.

Next, the effects of the prescribed embodiment are explained. As shown by dotted lines in FIG. 2, magnetic flux emitted from the permanent magnet 13 is conducted to the upper and lower ends of the permeability plates 12 which are magnetically connected through the permanent magnet 13, and is emitted from the upper and lower ends thereof into the space above and below the pickup. The magnetic flux emitted from the upper and lower ends forms a closed magnetic loop in a small area close to the string 11, due to the narrow 5 mm gap between the upper ends. When the string 11, which is also made of permeable materials moves through this small area, a current induced according to Fleming's right hand rule flows through the coil 14 so that an electrical signal corresponding to a vibration frequency of the string 11 is output, in the same way as with a conventional electromagnetic pickup.

Next, the principle of the reduction of induced noise is explained. Regarding induced noise entering from the upper and lower sides of the electromagnetic pickup 10, the electromagnetic pickup 10 fundamentally has a configuration which is almost not affected by induced noise, because magnetic flux emitted from the permeability plates 12 forms a magnetically closed loop in a small area. Further, induced noise entering from the upper and lower sides of the electromagnetic pickup 10 is directed to the opposed sides through the permeability plates 12. Even if noise is induced in the coil 14, it enters perpendicular to the axis of the coil 14 and thus electromotive force cannot be induced. Therefore, induced noise substantially becomes zero.

Also, since the permeability plates 12 are magnetically connected by the permanent magnet 13, a small quantity of noise is generated inside the coil 14 close to the point of contact between the plates 12 and the permanent magnet 13. However, the noise on the upper side of the coil 14 and the noise on the lower side of the coil 14 are opposite to each other in phase, so the noise is essentially cancelled out. Therefore, induced noise substantially becomes zero.

On the other hand, regarding induced noise entering from the horizontal direction, that is the direction of the axis of the coil 14, the induced noise generates an eddy current in the permeability plates 12, and is dissipated as heat loss. Therefore, effects of the induced noise are greatly reduced.

Further, the permeability plates 12 are also made of conductive materials, and are electrically connected to the ground side of the coil 14 by the ground wire 16. Therefore, each permeability plate 12 forms a shield against electrostatic noise.

In the embodiments as described above, as an example of an electric stringed instrument, an electric guitar is shown. However, the application of the present invention is not limited to an electric guitar. An electric stringed instrument may be a stringed instrument, e.g., an electric piano, an electric violin, etc., which converts a string vibration into an electrical signal.

As explained above, an electromagnetic pickup for an electric stringed instrument of the present invention, makes it possible to prevent the occurrency of undesired noise, e.g., induced noise, etc., in spite of the use of an electromagnetic type pickup, although the occurrency of the type of undesired noise cannot be avoided in the prior art. Therefore, it is possible to produce a very clear sound that is derived from only the string vibration and has an undesired noise level of substantially zero.

Also, since the electromagnetic pickup of the present invention has very few components, it is possible to make it very simple, small and inexpensive.

Further, since a design change by changing the distance between the two permeability plates can be easily made by changing the width of the permanent magnet and the length of the screws, it is easy to design or change tone color by adjusting, e.g., the number of coil turns, a gap width, etc.

Furthermore, since an electromagnetic pickup of the invention can be made very thin, it is possible to design new shape for an electromagnetic pickup for a stringed instrument, which could not be done by using a conventional electromagnetic pickup.

What is claimed is:

1. An electromagnetic pickup for an electric stringed instrument, comprising;

two parallel permeability plates placed perpendicular to strings;

a permanent magnet provided between said two permeability plates in parallel to said strings; and a coil wound around said permanent magnet, wherein said permanent magnet is in contact with said permeability plates in such a manner that portions of said permanent magnet that contact said permeability plates have opposed polarities.

2. An electromagnetic pickup as set forth in claim 1, wherein at least one of said parallel permeability plates is electrically connected to the ground side of said coil.

3. An electromagnetic pickup as set forth in claim 1, wherein said permeability plates are made of iron with a thickness of about 1 mm.

4. An electromagnetic pickup as set forth in claim 1, wherein said permeability plates are made of silicon steel plate.

5. An electromagnetic pickup as set forth in claim 1, wherein a gap width between said permeability plates is smaller than 1 cm.

6. An electromagnetic pickup as set forth in claim 5, wherein a tone color of an output signal is changed by adjusting said gap width between said permeability plates.

* * * * *